US005273457A

United States Patent [19]

Zell et al.

[11] Patent Number: 5,273,457

[45] Date of Patent: Dec. 28, 1993

[54] CONTACT ARRANGEMENT BETWEEN A COAX CABLE AND THE BLADES OF A WIRING BACKPLANE

[75] Inventors: Karl Zell, Niederpoecking; Peter Seidel, Groebenzell; Juergen Seibold, Baierbrunn, all of Fed. Rep. of Germany

[73] Assignee: Siemens Aktiengesellschaft, Munich, Fed. Rep. of Germany

[21] Appl. No.: 21,686

[22] Filed: Feb. 24, 1993

[30] Foreign Application Priority Data

Feb. 25, 1992 [DE] Fed. Rep. of Germany ..... 4205732

[51] Int. Cl.[5] ..... H01R 17/18

[52] U.S. Cl. ..... 439/581

[58] Field of Search ..... 439/578-585, 439/607-610

[56] References Cited

U.S. PATENT DOCUMENTS

| | | | |
|---|---|---|---|
| 4,664,467 | 5/1987 | Tengler et al. | 439/581 |
| 4,895,522 | 1/1990 | Grabbe et al. | 439/581 |
| 4,964,814 | 10/1990 | Tengler et al. | 439/581 |
| 5,211,581 | 5/1993 | Schwartz et al. | 439/581 |

*Primary Examiner*—Joseph H. McGlynn

*Attorney, Agent, or Firm*—Hill, Steadman & Simpson

[57] ABSTRACT

The invention is directed to a connector arrangement between a coax cable and the blades of a wiring backplane, wherein the contact blade carrying an electrical signal is surrounded by contact blades connected to the shielding potential. The connector arrangement includes a plug receiving an inner contact spring connected to an inner conductor of a coax cable with the contact spring receiving the signal-carrying contact blade and the braided shielding of the coax cable is connected to the contact blades lying at the shielding potential via a resilient spring collar having outwardly bent spring tongues in one end of the plug.

9 Claims, 2 Drawing Sheets

CONTACT ARRANGEMENT BETWEEN A COAX CABLE AND THE BLADES OF A WIRING BACKPLANE

BACKGROUND OF THE INVENTION

The present invention is directed to a connector arrangement between a coax cable and the blades of a wiring backplane within a module frame. The wiring backplane is continuously equipped with contact blades which are arranged in a rectangular pattern and a respective contact blade carrying an electrical signal is surrounded by contact blades which are connected to the shielding potential.

The problem frequently occurs wherein a coax cable must be electrically connected to lines of a wiring backplane. To that end, traditional and expensive coax plugs have been previously utilized. These coax plugs are plugged directly together with the module and require a relatively large hole therefor in the wiring backplane because of their size. Since larger and larger datasets are to be transported faster and faster and more and more reliably, the problem of shielding acquires greater and greater significance. Since feedthrough holes in the wiring backplane lead to greater resolution and shielding problems, the feedthrough holes are, therefore, extremely disadvantageous in view of the greater number of coax plugs.

SUMMARY OF THE INVENTION

The object of the present invention is to provide a connector arrangement for a coax cable to blades of a backplane that will allow a simple connection of the coax cable to the blades of the backplane without an additional operation in, for example, the form of an opening in the wiring backplane having to be undertaken and whereby the adequate shielding is assured for every connection.

This object is inventively achieved in that the signal-carrying contact blade will project through an opening of a catch knob arranged on the wiring backplane and that a first end of a plug can be latched onto the catch knob. The plug will have an inner conductor of the cable connected to a signal-carrying contact blade via a contact spring arranged on the inside of the plug adjacent the first end, and the braided shielding of the cable is connected to the contact blades lying at a shielding potential through a spring-born resilient spring collar that is arranged between an outer pinch sleeve and the plastic housing of the plug and comprises outwardly bent open spring tongues adjacent the first end of the plug for engaging these blades.

The connector arrangement of the invention makes it possible in a simple way to create a connection between a coax cable and the lines of a wiring backplane without having to undertake additional operations in the wiring backplane. At the same time, an adequate shielding of the contact blade carrying the electrical signal is established.

An advantageous development of the connector arrangement of the invention is characterized in that one region of the catch knob comprises an outwardly directed circular bead which is embraced by a spring collar situated on the first end of the plug. A guide part with a quadratic cross section is provided on the plug between the spring collar of the first end and the spring tongues, and this guide part comprises incisions or grooves on an outer edge and corners, whose contour coincides with the contour of the neighboring contact blades facing toward the plug. A reliable guidance of the plug before it is engaged is effected in this way so that the outwardly bent open spring tongues will press exactly against the neighboring contact blades that carry the shielding potential.

Another especially advantageous development of the invention is that a fastening disk is embedded within the catch knob in the region of the opening, and the fastening disk is provided with an opening for plugging the contact blade through the disk. When the disk is turned, the parts of the inner edges of the fastening disks cut into the contact blade and parts of the outer edges of the fastening disks cut into the material of the catch knob. Thus, a firm connection between the signal-carrying contact blade, catch knob and wiring backplane is produced in a simple way.

Other advantages and features of the invention will be readily apparent from the following description of the preferred embodiments, the drawings and claims.

BRIEF DESCRIPTION OF THE DRAWINGS

FIG. 4 being a cross sectional view taken along the lines IV—IV of FIG. 3; and FIG. 5 being a cross sectional view taken along the lines V—V of FIG. 3.

DESCRIPTION OF THE PREFERRED EMBODIMENTS

The principles of the present invention are particularly useful in a connector arrangement which is essentially composed of a plug generator indicated at 30, a catch knob 6, and a contact blade 8*a* of a wiring backplane 9. The fastening of the catch knob 6 with a fastening disk 7 will be set forth later. The respective contact blade 8*a* carries the electrical signal and is surrounded by eight contact blades 8, which are connected to shielding potential (see FIG. 2).

Figure 1:
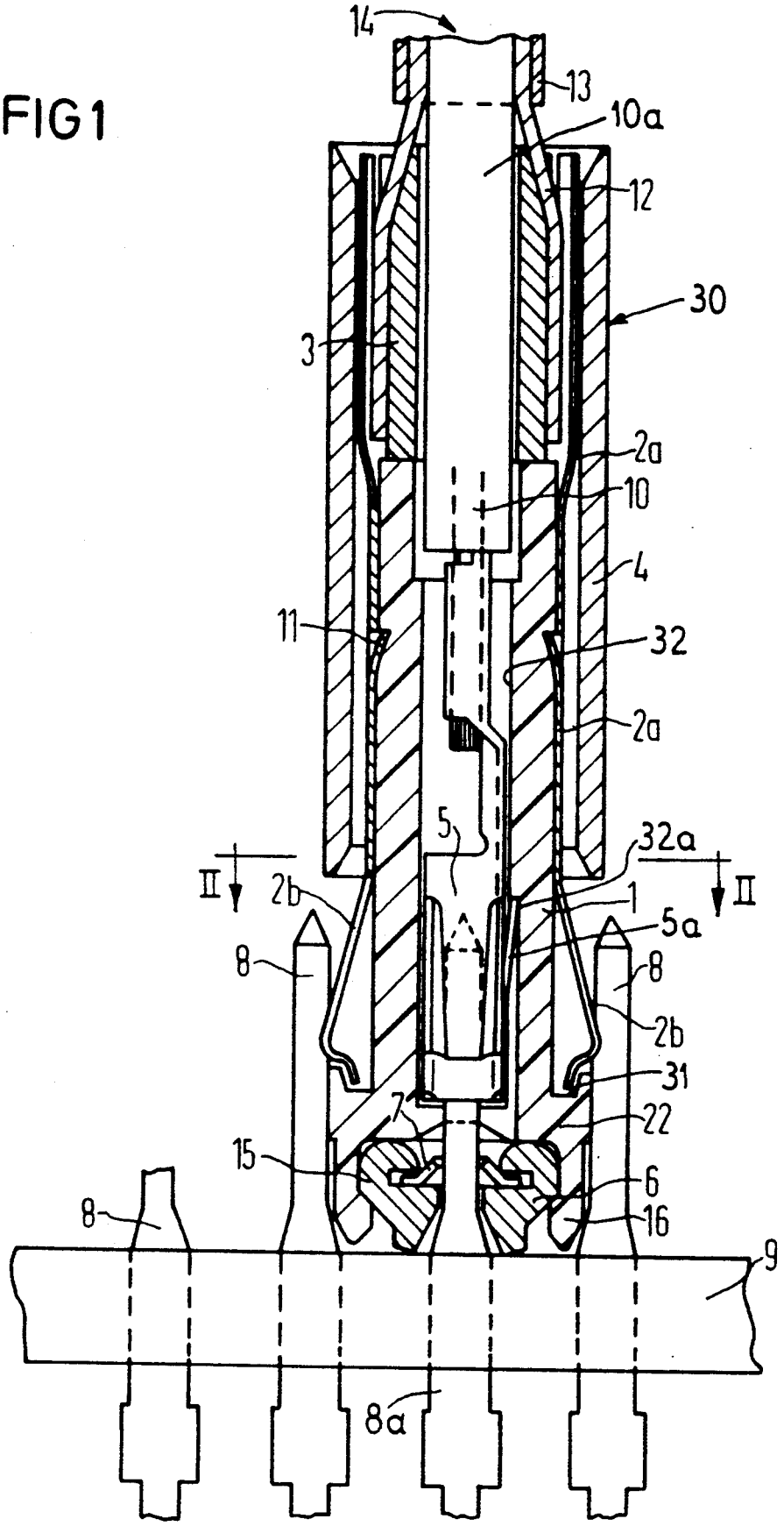
FIG. 1 is a longitudinal cross sectional view with portions in elevation of a connector in accordance with the present invention.

An incoming coax cable, generally indicated at 14, has an inner connector 10 separated by a structure 10*a* from a braided cable shielding 12, which is enclosed in an outer sheath or protective covering 13. As illustrated in FIG. 1, the cable 14 terminates in the coax plug 30, which includes a plastic housing 1, a pressure sleeve 3, a pinch sleeve 4, an inner contact spring 5 and a resilient spring collar 2*a* comprising spring tongues 2*b*. The inner contact spring 5 is firmly contacted to the inner conductor 10 of the coax cable 14 and is received inside of a bore 32 of the plug or plastic housing 1. To form the connection, the contact spring 5 firmly contacts a contact blade 8*a*, which carries the electrical signal applied to the inner connector 10. The braided shielding 12 is connected to the resilient spring 2*a* by having the pressure sleeve 3 inserted between the shielding 12 and the structure 10*a*. The pinch sleeve 4 is pushed over this arrangement and holds the spring element 2*a* in contact with the braided cable shielding 12. The assembly and the strain relief essentially correspond to the structural solution of known coax plugs. The braided shielding 12 is pinched into engagement with the resilient spring 2*a* by the pressure sleeve 3 and the pinch sleeve 4 with traditional pliers. As a result thereof, the relief strain for the inner conductor is realized. For greater reliability when pulling the plug, the resilient spring collar 2a is secured with claws 11 that engage or dig into the outer surface of the plastic housing 1. Also, the contact spring 5 has a tab or claw 5a that engages a shoulder 32a of the bore 32.

Figure 2:
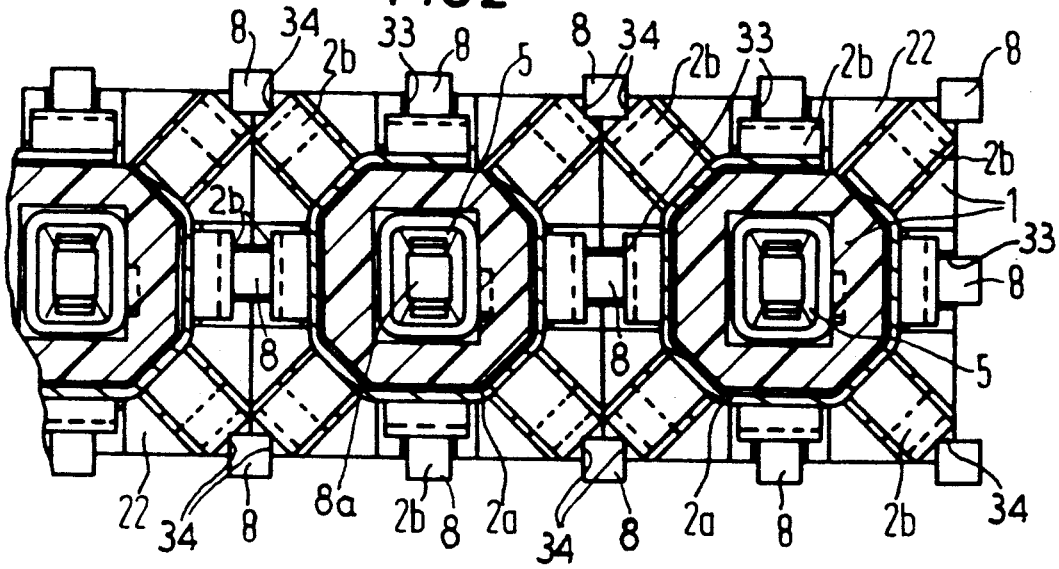
FIG. 2 is a cross sectional view taken along approximately lines II—II of FIG. 1 with portions removed for purposes of illustration.

In the present exemplary embodiment, the resilient spring collar 2a will end in eight spring tongues 2b that will connect the braided shielding 12 of the coax cable 14 to the surrounding eight contacts 8 that surround each of the blades 8a (see FIG. 2). Thus, the braided shielding 12 of the coax cable will be in contact with the shielding potential connected to the eight pins or blades 8.

The plug 1, at a first end adjacent the wiring backplane 9, will have a spring collar 16. The spring collar 16 is circularly fashioned and engages around an annular bead 15 of the catch knob 6 and, thus, will lock the plug 1 onto the catch knob 6. In the plug of the present invention, a guide part 22 is provided above the spring collar 16, as illustrated in FIG. 1. The guide part 22 comprises a quadratic shape, as illustrated in FIG. 2, and is provided with cutouts 33 and 34 that correspond to the neighboring contact blades 8. The cutouts 33 are provided on the sides and the cutouts 34 are provided at the corners of the part 22. The guide part 22 is also provided with a groove 31 which receives the end of each of the spring tongues 2b, which groove limits the outward radial movement of each of the spring tongues so that when inserting the plug 30 onto the contact blade 8a, the spring tongues 2b will engage the surrounding contact blades 8.

Figure 3:
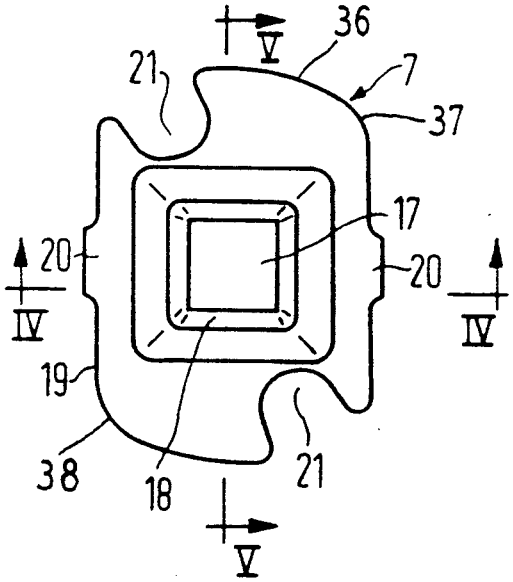
- FIGS. 3-5 are views of the fastening disk for fastening the catch knob, with FIG. 3 being a top plan view.
Figure 4:
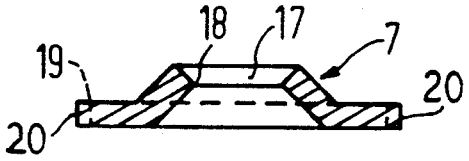
Figure 5:
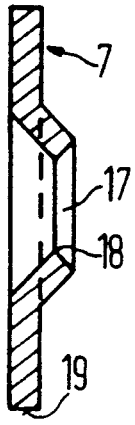

The catch knob 6 is firmly connected by a fastening disk 7 onto the contact blade 8a that carries the electrical signal. The fastening disk, as illustrated in FIG. 3, has essentially a rectangular shape with long outside edges 19, which are essentially straight and each edge 19 has a midpoint with a projection 20. The projections 20 in the built-in condition of the fastening disk are situated under impressions or projections of the knob 6 (not shown in greater detail here) and hold the disk in its position after it has been placed into the catch knob 6. The shorter outside edges 36 of the fastening disk 7 are arcuately shaped. An opening 17 of the fastening disk 7 is fashioned nozzle-like or deformed from a plane of the disk 7 (see FIGS. 4 and 5) so that a sharp edge 18 is ready to engage the contact blade 8a. It should be noted that the dimensions of the opening 17 essentially correspond to the cross section of the contact blade 8a. Another advantage of the opening 17 being in a base of a truncated core or pyramid is the sharp edge 18 that occurs. The recesses, such as 21, into which a male member of a turning tool for turning the fastening disks can engage, are provided at the two corners of the fastening disk 7 and lie diagonally opposite one another.

After the catch knob 22 equipped with the fastening disk 7 has been plugged onto the contact blade, such as 8a, the fastening disk 7 is turned with the turning tool. When one assumes a clockwise rotational sense, then it can be seen from FIG. 3 that all four sharp inside edges 18 cut into the material of the contact blade 8a. An upper right corner 37 and a lower left corner 38 of the fastening disk 7 will cut into the material of the catch knob 6. This cutting into the material of the catch knob 6 is promoted by the arcuate fashioning of the shorter outside edges 36. After the fastening disks have been turned, an interlocking anchoring between the contact blade 8a, the fastening disk 7 and the catch knob 6 will occur. It is, thus, assured that the plug can be reliably pulled and plugged many times.

The plug connector shown in the drawings has an area of 5×5 mm given a division spacing of the contact blades of 2.5 mm and can be plugged into a wiring backplane without the loss of division. Coax connections to the wiring backplane can be obtained with the connector arrangement of the invention without having to make holes in the wiring backplane and without having to perform additional operations on the structure of the wiring backplane. With the connector arrangement of the present invention, the grounding points of the respective two plugs can thereby be contacted in common, as illustrated in FIG. 2.

Although various minor modifications may be suggested by those versed in the art, it should be understood that we wish to embody within the scope of the patent granted hereon all such modifications as reasonably and properly come within the scope of our contribution to the art.

We claim:

1. A connector arrangement between a coax cable and the blades of a wiring backplane within a module frame, the wiring backplane being continuously equipped with contact blades arranged in a rectangular pattern with a respective contact blade carrying an electrical signal being surrounded by contact blades connected to a shielding potential, said connector arrangement comprising a catch knob being telescopically received on a signal-carrying contact blade of the wiring backplane, a plug having one end latched onto the latch knob, said plug having a signal-carrying contact spring arranged in a bore of the plug for connection to an inner conductor of the cable, said plug supporting a resilient spring collar which is arranged between an outer pinch sleeve and the plastic plug for crimping engagement onto a braided shielding of the cable, said resilient spring collar having a plurality of open spring tongues adjacent the first end of the plug for forming contacts with the contact blades which surround the signal-carrying contact blade and are connected to the shielding potential.

2. A connector arrangement according to claim 1, wherein the front region of the latch knob has an outwardly directed circular bead which is embraced by a spring collar situated on the first end of the plug, a guide part having a quadratic cross section is provided on the plug adjacent the first end between the spring collar and the spring tongues of the resilient spring collar, said guide part having cutouts adjacent the outer edges and corners for receiving the neighboring contact blades facing toward the plug and surrounding the signal-carrying contact blade.

3. A connector arrangement according to claim 2, wherein the catch knob includes a fastening disk embedded therein in the region of the opening, said fastening disk being provided with an opening for receiving the contact blade, said disk being turned so that a part of an inner edge of the disk cuts into the contact blade and parts of the outer edge of the fastening disk cut into the material of the contact knob to insure connection.

4. A connector arrangement according to claim 3, wherein the outer dimensions of the fastening disk are essentially rectangular, wherein the longer outside edges are substantially straight and have projections lying adjacent at a midpoint of each edge, the shorter outside edges are arcuately fashioned, the opening has a conical shape pressed from the plane of the disk with the opening corresponding to the cross section of the contact blade, said disk having recesses for engagement by turning tools arranged at two corners lying diagonally opposite one another.

5. A connector arrangement according to claim 3, wherein the catch knob has an essentially rectangular depression for accepting the fastening disk, the fastening disk is held movably within the depression by impressions respectively engaging the longitudinal edges of the depression after the insertion of the fastening disk.

6. A connector arrangement according to claim 5, wherein the outside dimensions of the fastening disk are essentially rectangular, wherein the longer side edges are fashioned straight and have projections lying at the midpoint of the edge, the shorter outside edges having a curved configuration, said fastening disk having recesses at two diagonal opposite corners for receiving a turning tool, said opening in the fastening disk being formed in the base of a truncated cone depressed out of the disk, said opening having a cross section corresponding substantially to the cross section of the contact blade to be received therein.

7. A connector arrangement according to claim 1, wherein a fastening disk is embedded within the catch knob and the region of the opening, said fastening disk being provided with an opening for receiving the contact blade as the catch knob is inserted thereon, said opening of the fastening disk cutting into the contact blade as the disk is rotated relative to the contact disk and the catch knob with the outer edges of the disk cutting into the material of the catch knob.

8. A connector arrangement according to claim 7, wherein the catch knob has an essentially rectangular depression for receiving the fastening disk, said fastening disk is held movably captive within the catch knob.

9. A connector element according to claim 8, wherein the outside dimensions of the fastening disk are essentially rectangular, with the longer side edges being fashioned straight and having projections at their middle for engaging impressions in the recess of the catch knob, the shorter outside edges being arcuate fashioned, the nozzle opening having a cross section corresponding to the cross section of the contact blade, and the disk having recesses for engagement by a turning tool being arranged at two diagonal corners of the disk.

* * * * *